US010369789B2

(12) United States Patent
Naito

(10) Patent No.: US 10,369,789 B2
(45) Date of Patent: Aug. 6, 2019

(54) LIQUID EJECTION DEVICE

(71) Applicant: BROTHER KOGYO KABUSHIKI KAISHA, Nagoya-shi, Aichi-ken (JP)

(72) Inventor: Kyohei Naito, Nagoya (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/948,096

(22) Filed: Apr. 9, 2018

(65) Prior Publication Data

US 2018/0229500 A1 Aug. 16, 2018

Related U.S. Application Data

(63) Continuation of application No. 15/409,770, filed on Jan. 19, 2017, now Pat. No. 9,962,933.

(30) Foreign Application Priority Data

Jan. 25, 2016 (JP) ..... 2016-011347

(51) Int. Cl.
*B41J 2/14* (2006.01)

(52) U.S. Cl.
CPC .. *B41J 2/14233* (2013.01); *B41J 2002/14419* (2013.01); *B41J 2002/14491* (2013.01)

(58) Field of Classification Search
CPC ..... B41J 2/14233; B41J 2002/14491; B41J 2002/14419
See application file for complete search history.

(56) References Cited

U.S. PATENT DOCUMENTS

| | | | |
|---|---|---|---|
| 8,616,683 | B2 | 12/2013 | Hara |
| 2005/0046678 | A1 | 3/2005 | Owaki et al. |
| 2014/0232787 | A1 | 8/2014 | Owaki |
| 2015/0077471 | A1 | 3/2015 | Yoneta |

FOREIGN PATENT DOCUMENTS

| | | | |
|---|---|---|---|
| JP | 2008-273218 | A | 11/2008 |
| JP | 2014-156065 | A | 8/2014 |

OTHER PUBLICATIONS

Notice of Allowance dated Jan. 10, 2018 from U.S. Appl. No. 15/409,770.

*Primary Examiner* — Sharon A. Polk
(74) *Attorney, Agent, or Firm* — Scully, Scott, Murphy & Presser, P.C.

(57) ABSTRACT

A liquid ejection device is disclosed. One liquid ejection device includes a plurality of first contacts connected to a plurality of first piezoelectric elements, respectively, and positioned at a more outer position than a first piezoelectric element row and a second piezoelectric element row from a center of the device in a second direction. The liquid ejection device includes a plurality of second contacts connected to a plurality of second piezoelectric elements, respectively, and positioned at a more outer position than a third piezoelectric element row and a fourth piezoelectric element row from the center of the liquid ejection device in the second direction.

13 Claims, 11 Drawing Sheets

LIQUID EJECTION DEVICE

CROSS-REFERENCE TO RELATED APPLICATION

This application is a continuation application of U.S. Ser. No. 15/409,770 filed on Jan. 19, 2017 and claims priority from Japanese Patent Application No. 2016-011347 filed on Jan. 25, 2016, the contents of each of which are incorporated herein by reference in their entirety.

FIELD OF DISCLOSURE

Aspects disclosed herein relate to a liquid ejection device.

BACKGROUND

An inkjet head that ejects ink from nozzles has been known as a liquid ejection device. For example, the known inkjet head includes four flow path substrates, a single communication plate, four nozzle plates, and a plurality of piezoelectric elements. The flow path substrates includes the piezoelectric elements.

Each flow path substrate has pressure chambers that are aligned in two rows. That is, the four flow path substrates include a combined total of eight pressure-chamber rows. The flow path substrates are joined to one of opposite surfaces of the communication plate. The communication plate has manifolds corresponding to the respective pressure-chamber rows. The pressure chambers constituting each pressure-chamber row are supplied with ink from a corresponding one of the manifolds. The nozzle plates are joined to the other of the opposite surfaces of the communication plate. Each nozzle plates includes two nozzle rows corresponding to the two pressure-chamber rows of a corresponding one of the flow path substrates.

Each flow path substrate includes piezoelectric elements on its one surface opposite to its other surface to which the communication plate is joined. The piezoelectric elements are aligned in two rows in accordance with the arrangement pattern of the corresponding pressure chambers. That is, the four flow path substrates include a combined total of eight piezoelectric-element rows corresponding to the eight pressure-chamber rows. A lead electrode (e.g., a lead) is connected to an individual electrode of each piezoelectric element. An end portion of each lead electrode included in adjacent two piezoelectric-element rows extends to an area between the piezoelectric-element rows. In the area between the piezoelectric-element rows, the end portions (e.g., contacts) of the lead electrodes are aligned along a direction in which the pressure chambers are aligned. A wiring member, e.g., a chip-on-film ("COF"), is joined to the contacts. That is, a single wiring member is provided for two piezoelectric-element rows of a single flow path substrate. Thus, the known inkjet head has a total of four wiring members.

SUMMARY

In each flow path substrate of the known inkjet head, the contacts may be positioned between the adjacent two piezoelectric-element rows, and a single wiring member may be joined to the contacts. However, this configuration may require a sufficient space between the adjacent two pressure-chamber rows to place the contacts therebetween. In response to this, a distance between adjacent nozzles rows corresponding to the pressure-chamber rows may also be increased. The increase of the distance between the nozzle rows may cause relatively large differences between the nozzle rows in landing position of ink droplets ejected from nozzles of the nozzle rows, which may be caused if, for example, the inkjet head is mounted inclinatorily.

Accordingly, some embodiments of the disclosure provide for a liquid ejection device including piezoelectric elements aligned in four or more rows, wherein while an area where contacts of the piezoelectric elements are positioned is secured, a distance between adjacent nozzle rows may be reduced.

According to one aspect of the disclosure, a liquid ejection device includes a first channel member having a plurality of first pressure chambers constituting a first pressure-chamber row and a second pressure-chamber row. The first and second pressure-chamber rows extend along a first direction and the second pressure-chamber row is next to the first pressure-chamber row in a second direction orthogonal to the first direction. The liquid ejection device includes a second channel member positioned next to the first channel member in the second direction, the second channel member having a plurality of second pressure chambers constituting a third pressure-chamber row and a fourth pressure-chamber row. The third and fourth pressure-chamber rows extend along the first direction and the fourth pressure-chamber row is next to the third pressure-chamber row in the second direction. The liquid ejection device includes a plurality of first piezoelectric elements positioned corresponding to the plurality of first pressure chambers, respectively, the plurality of first piezoelectric elements constituting a first piezoelectric-element row and a second piezoelectric-element row. The second piezoelectric-element row is next to the first piezoelectric-element row in the second direction. The liquid ejection device includes a plurality of second piezoelectric elements positioned corresponding to the plurality of second pressure chambers, respectively, the plurality of second piezoelectric elements constituting a third piezoelectric-element row and a fourth piezoelectric-element row. The fourth piezoelectric-element row is next to the third piezoelectric-element row in the second direction. The liquid ejection device includes a plurality of first contacts connected to the plurality of first piezoelectric elements, respectively, and positioned at a more outer position than the first piezoelectric element row and the second piezoelectric element row from a center of the liquid ejection device in the second direction. The liquid ejection device includes a plurality of second contacts connected to the plurality of second piezoelectric elements, respectively, and positioned at a more outer position than the third piezoelectric element row and the fourth piezoelectric element row from the center of the liquid ejection device in the second direction.

According to further aspect of the disclosure, a liquid ejection device includes a first channel member having a pressure chamber A elongated along a longitudinal direction and a pressure chamber B next to the pressure chamber A in the longitudinal direction. The liquid ejection device includes a second channel member disposed next to the first channel member in the longitudinal direction, the second channel member having a pressure chamber C and a pressure chamber D positioned next to the pressure chamber in the longitudinal direction. The liquid ejection device includes a piezoelectric element A and a piezoelectric element B positioned corresponding to the pressure chamber A and the pressure chamber B, respectively. The piezoelectric element B is next to the piezoelectric element A in the longitudinal direction. The liquid ejection device includes a piezoelectric element C and a piezoelectric element D positioned corresponding to the pressure chamber C and the pressure chamber D, respectively. The piezoelectric element D is next to the piezoelectric element C in the longitudinal direction. The liquid ejection device includes a contact A and a contact B connected to the piezoelectric element A and the piezoelectric element B, respectively. The contact A and the contact B are positioned at respective outer positions than the piezoelectric element A and the piezoelectric element B from a center of the liquid ejection device in the longitudinal direction. The liquid ejection device includes a contact C and a contact D connected to the piezoelectric element C and the piezoelectric element D, respectively. The contact C and the contact D are positioned at respective outer positions than the piezoelectric element C and the piezoelectric element D from the center of the liquid ejection device in the longitudinal direction.

According to further aspect of the disclosure, a liquid ejection device includes a first channel member having a plurality of first pressure chambers constituting a first pressure-chamber row and a second pressure-chamber row. The first and second pressure-chamber rows extend along a first direction and the second pressure-chamber row is next to the first pressure-chamber row in a second direction orthogonal to the first direction. The liquid ejection device includes a second channel member positioned next to the first channel member in the second direction, the second channel member having a plurality of second pressure chambers constituting a third pressure-chamber row and a fourth pressure-chamber row. The third and fourth pressure-chamber rows extend along the first direction and the fourth pressure-chamber row is next to the third pressure-chamber row in the second direction. The liquid ejection device includes a plurality of first piezoelectric elements positioned corresponding to the plurality of first pressure chambers, respectively, the plurality of first piezoelectric elements constituting a first piezoelectric-element row and a second piezoelectric-element row. The second piezoelectric-element row is next to the first piezoelectric-element row in the second direction. The liquid ejection device includes a plurality of second piezoelectric elements positioned corresponding to the plurality of second pressure chambers, respectively, the plurality of second piezoelectric elements constituting a third piezoelectric-element row and a fourth piezoelectric-element row. The fourth piezoelectric-element row is next to the third piezoelectric-element row in the second direction. The liquid ejection device includes a plurality of first contacts connected to the plurality of first piezoelectric elements, respectively. The liquid ejection device includes a plurality of second contacts connected to the plurality of second piezoelectric elements, respectively. The first piezoelectric element row and the second piezoelectric element row are positioned between the plurality of first contacts and the second channel member in the second direction. The third piezoelectric element row and the fourth piezoelectric element row are positioned between the plurality of second contacts and the first channel member in the second direction.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Figure 1:
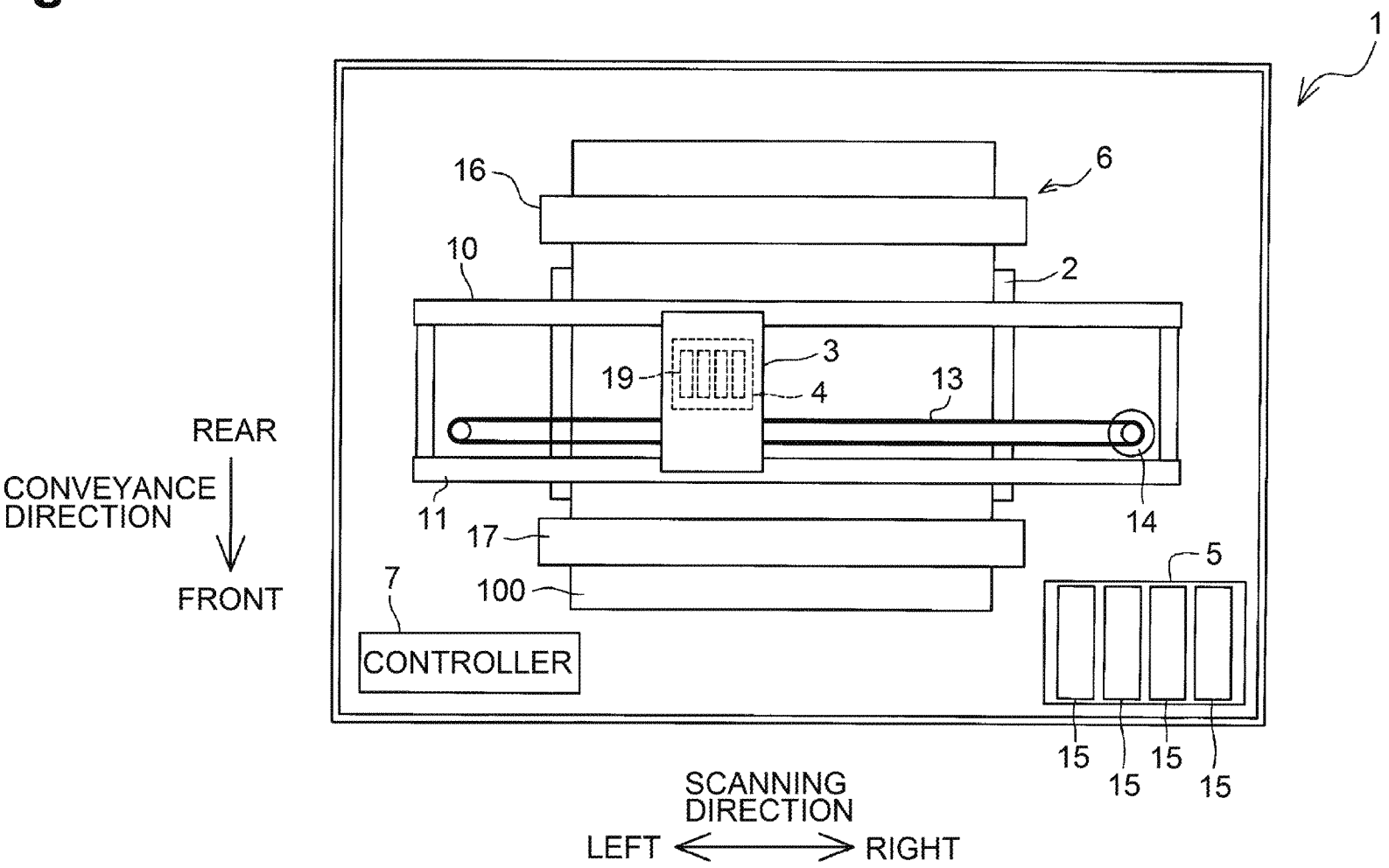
FIG. 1 is a schematic plan view of a printer in an illustrative embodiment according to one or more aspects of the disclosure.

An illustrative embodiment will be described with reference to the accompanying drawings. FIG. 1 is a schematic plan view of an inkjet printer 1 according to the illustrative embodiment. The front, rear, right, and left defined in FIG. 1 are applied to the front, rear, right, and left of the inkjet printer 1. The top and bottom of the inkjet printer 1 may be defined with reference to an orientation of the inkjet printer 1 that may be disposed in which it may be intended to be used. Hereinafter, an explanation will be made with reference to the defined directions appropriately.

(General Configuration of Printer)

As illustrated in FIG. 1, the inkjet printer 1 includes a platen 2, a carriage 3, an inkjet head 4, a cartridge holder 5, a conveyor 6, and a controller 7.

The platen 2 is configured to support a recording sheet 100 (e.g., a recording medium) on an upper surface thereof. The carriage 3 is configured to reciprocate in a right-left direction along guide rails 10 and 11 in an area facing the platen 2. Hereinafter, the direction in which the carriage 3 reciprocates (e.g., the right-left direction) may also be referred to as a "scanning direction". An endless belt 13 is connected to the carriage 3. The endless belt 13 rotates by driving of a carriage drive motor 14. By rotation of the endless belt 13, the carriage 3 moves in the scanning direction.

The inkjet head 4 is mounted on the carriage 3. The inkjet head 4 is configured to move along the scanning direction together with the carriage 3. The inkjet head 4 includes a plurality of, for example, four head units 19 that are placed side by side in the scanning direction. Each of the head units 19 has nozzles 36 (refer to FIGS. 2 to 4) in its lower surface (not shown in FIG. 1). The head units 19 will be described in detail later.

The cartridge holder 5 is configured such that ink cartridges 15 storing respective color inks (e.g., black, yellow, cyan, and magenta) are attachable thereto and detachable therefrom independently. The ink cartridges 15 are connected to the respective corresponding head units 19 via respective tubes (not illustrated). Inks stored in the respective ink cartridges 15 are supplied to the respective corresponding head units 19 via the respective tubes. In accordance with reciprocation of the carriage 3, one or more of the head units 19 eject ink from the nozzles 36 toward a recording sheet 100 supported by the platen 2.

The conveyor 6 includes a plurality of, for example, two conveyor rollers 16 and 17. The conveyor rollers 16 and 17 are disposed opposite to each other across the platen 2 in a front-rear direction. The conveyor rollers 16 and 17 are driven by a conveyor motor (not illustrated) simultaneously to convey a recording sheet 100 frontward. Hereinafter, a direction in which a recording sheet 100 is conveyed (e.g., the front-rear direction) may be also referred to as a "conveyance direction".

The controller 7 includes a central processing unit ("CPU"), a read only memory ("ROM"), a random access memory ("RAM"), and an application specific integrated circuit ("ASIC"). The CPU executes an appropriate program stored in the ROM to cause the ASIC to perform various processes, e.g., a printing process. For example, in the printing process, based on a print instruction inputted from an external device, e.g., a personal computer, the controller 7 controls the inkjet head 4, the carriage drive motor 14, and the conveyor motor for the conveyor 6 to print an image onto a recording sheet 100. More specifically, for example, the controller 7 executes alternately and repeatedly control for ejecting ink and control for conveying a recording sheet 100. In ink ejection control, the controller 7 causes the inkjet head 4 to eject ink therefrom while moving the inkjet head 4 along the scanning direction together with the carriage 3. In sheet conveyance control, the controller 7 causes the conveyor 6 to convey the recording sheet 100 by a predetermined amount by the conveyor rollers 16 and 17.

<Details of Head Units>

Figure 2:
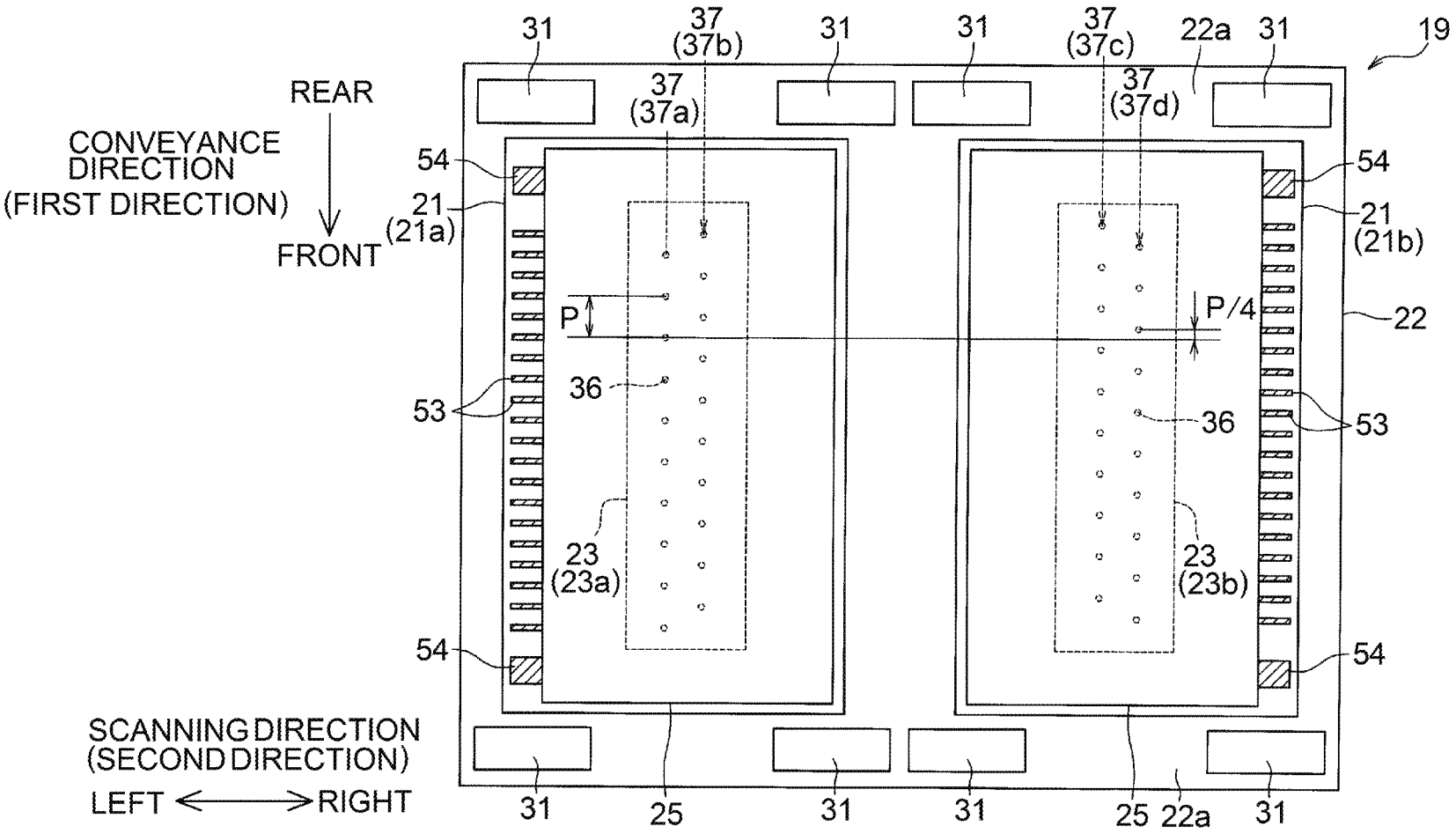
FIG. 2 is a top plan view of one of head units in the illustrative embodiment according to one or more aspects of the disclosure.
Figure 3:
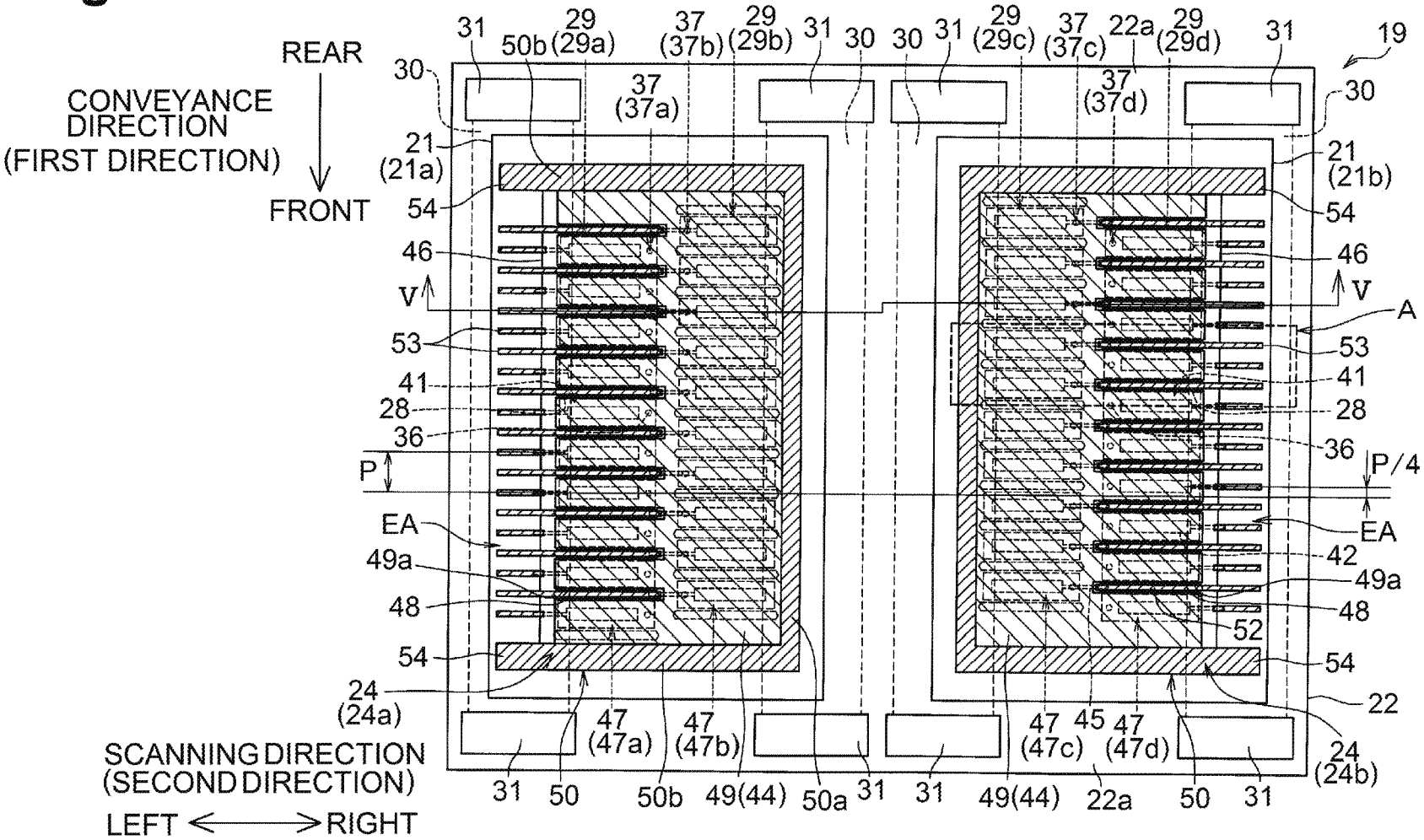
FIG. 3 is a top plan view of the head unit in the illustrative embodiment according to one or more aspects of the disclosure, wherein cover members are omitted.
Figure 4:
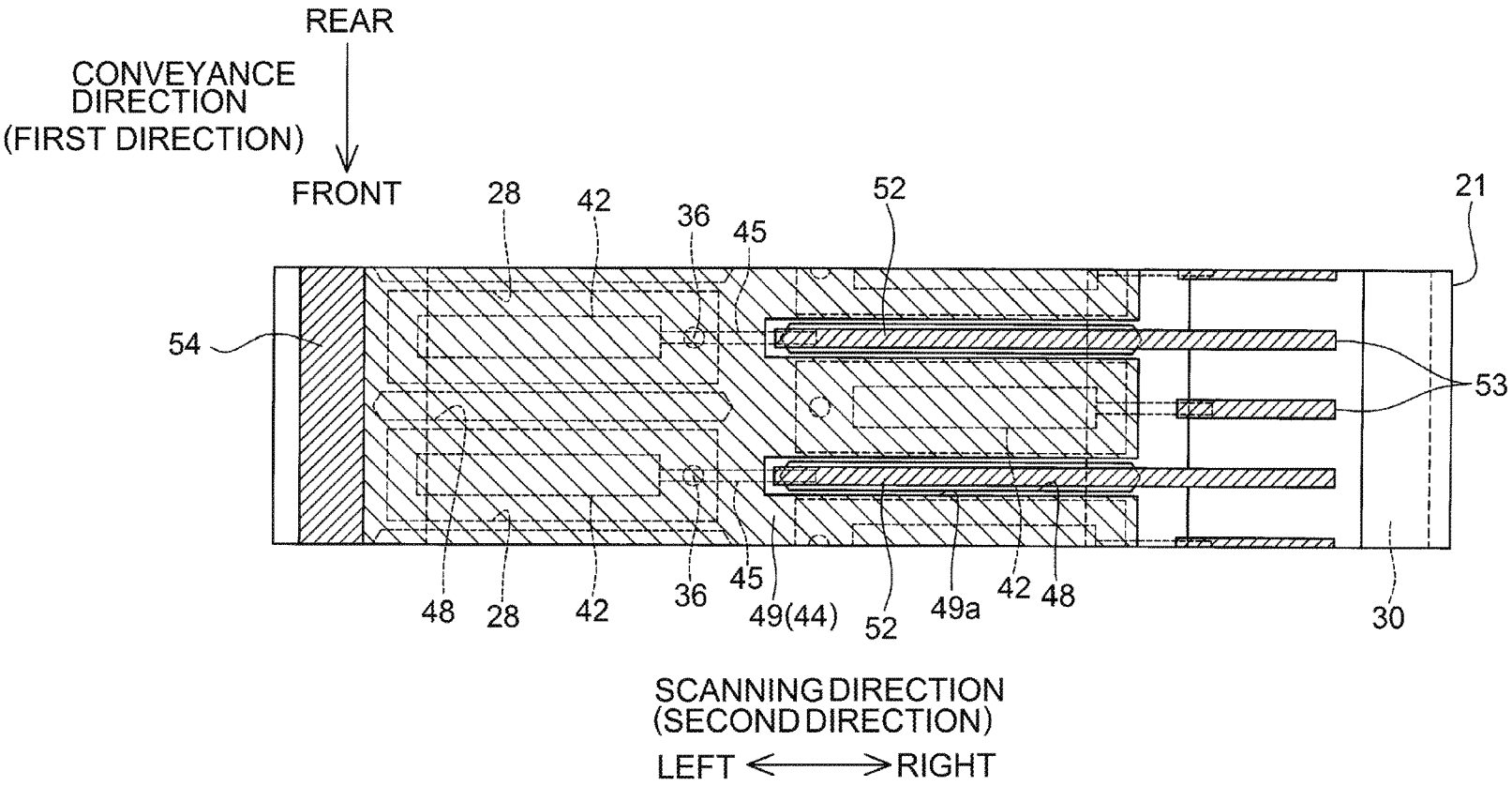
FIG. 4 is an enlarged view of a portion A of FIG. 3 in the illustrative embodiment according to one or more aspects of the disclosure.
Figure 5:
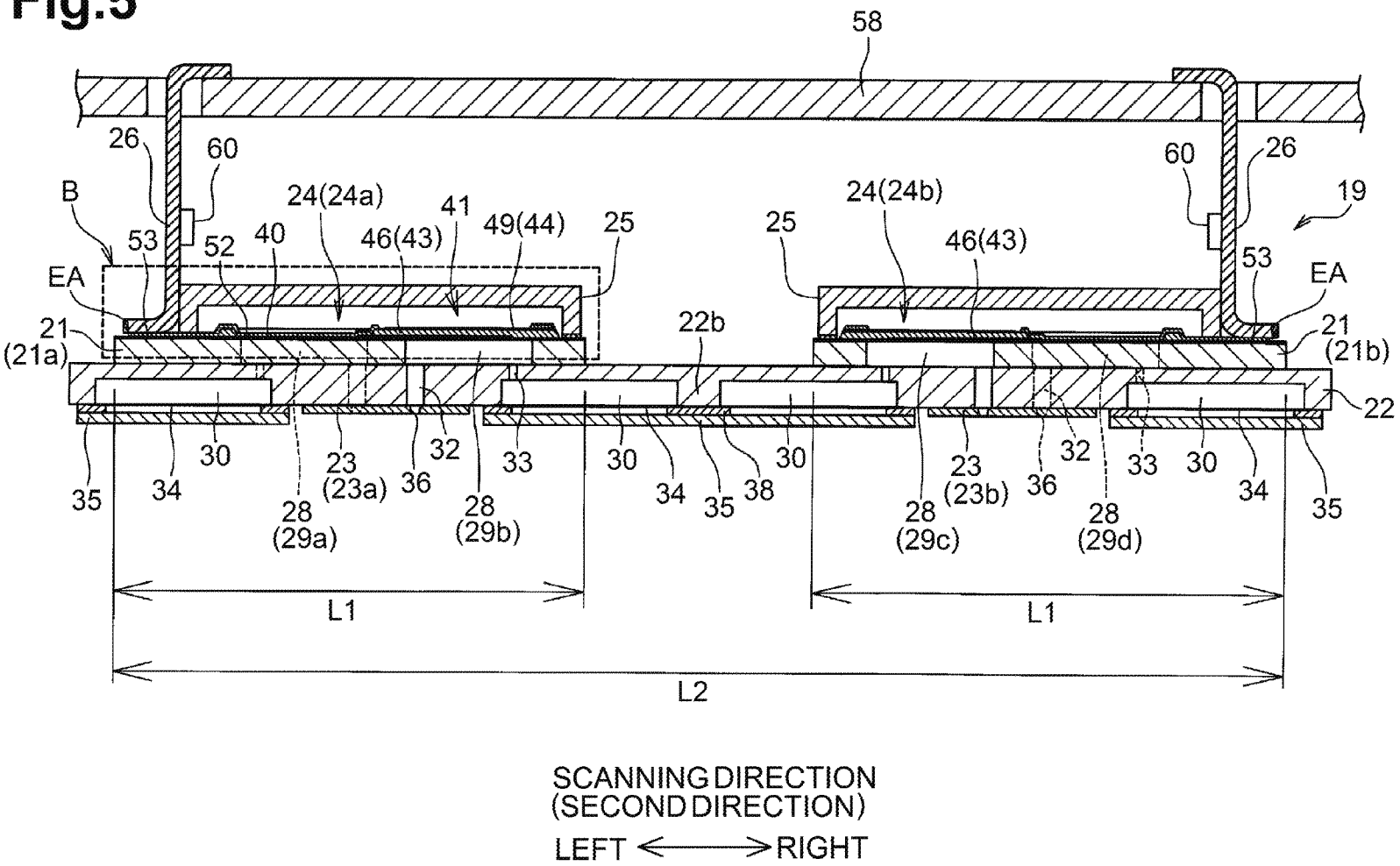
FIG. 5 is a sectional view taken along line V-V of FIG. 3 in the illustrative embodiment according to one or more aspects of the disclosure.
Figure 6:
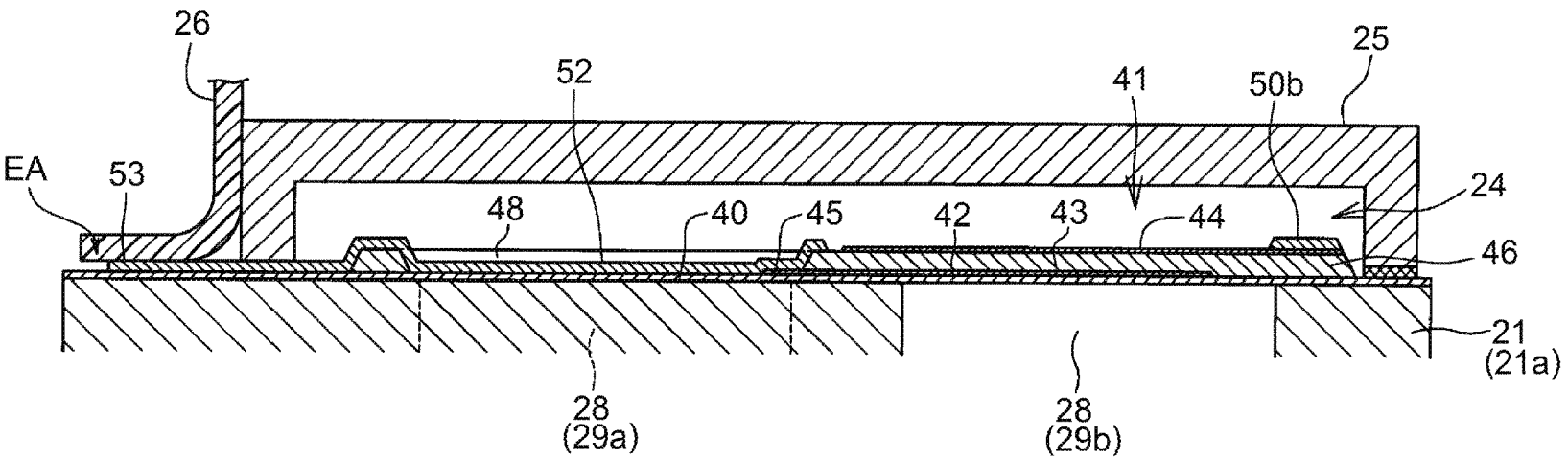
FIG. 6 is an enlarged view of a portion B of FIG. 5 in the illustrative embodiment according to one or more aspects of the disclosure.

Hereinafter, the head units 19 will be described in detail. All the four head units 19 have the same or similar configuration and function in the same or similar manner to each other. Therefore, one of the head units 19 will be described in detail, and an explanation for the others will be omitted. FIG. 2 is a top plan view of one of the head units 19. FIG. 3 is a top plan view of the head unit 19, in which cover members 25 are omitted. FIG. 4 is an enlarged view of a portion A of FIG. 3. FIG. 5 is a sectional view taken along line V-V of FIG. 3. FIG. 6 is an enlarged view of a portion B of FIG. 4. As illustrated in FIGS. 2 to 6, the head unit 19 includes a plurality of, for example, two channel substrates 21, a manifold substrate 22, a plurality of, for example, two nozzle plates 23, a plurality of, for example, two piezoelectric actuators 24, a plurality of, for example, two cover members 25, and a plurality of, for example, two COFs 26.

(Channel Substrates, Manifold Substrate, and Nozzle Plates)

Hereinafter, the channel substrates 21, the manifold substrate 22, and the nozzle plates 23 will be described. The channel substrates 21 (e.g., 21*a* and 21*b*), the manifold substrate 22, and the nozzle plates 23 (e.g., 23*a* and 23*b*) each may be formed of a single-crystalline silicon substrate. These substrates or plates are laminated in a top-bottom direction such that the channel substrates 21 are located at the top of the laminated structure, the manifold substrate 22 is located below the channel substrates 21, and the nozzle plates 23 are located below the manifold substrate 22.

The channel substrates 21 (e.g., 21*a* and 21*b*) are positioned side by side in the scanning direction. Each of the channel substrates 21 has a plurality of pressure chambers 28. Each pressure chamber 28 has a rectangular shape having longer sides extending along the scanning direction in plan view.

In each of the channel substrates 21, the pressure chambers 28 constitute a plurality of, for example, two pressure-chamber rows 29 that extend along the conveyance direction and are positioned side by side in the scanning direction. That is, the two channel substrates 21 include a combined total of four pressure-chamber rows 29. In other words, the channel substrate 21*a* includes the left two pressure-chamber rows 29 (e.g., 29*a* and 29*b*) and the channel substrate 21*b* includes the remainder, the right two pressure-chamber rows 29 (e.g., 29*c* and 29*d*). That is, two separate channel substrates 21 are provided. Since the left channel substrate 21 including the left pressure-chamber rows 29*a* and 29*b* and the right channel substrate 21 including the right pressure-chamber rows 29*c* and 29*d* are separate plates, a size of the individual channel substrates 21 may be reduced considerably. More specifically, for example, as illustrated in FIG. 5, each of the channel substrates 21 has a dimension of L1 in the scanning direction. If a single channel substrate includes all the four pressure-chamber rows 29, the channel substrate may have a dimension of L2 in the scanning direction. The dimension L1 of each of the channel substrates 21 is smaller than a half of the dimension L2 of the single channel substrate including the four pressure-chamber rows 29.

The pressure chambers 28 are aligned along the conveyance direction in each pressure-chamber row 29. Between the pressure-chamber rows 29*a*, 29*b*, 29*c*, and 29*d*, the pressure chambers 28 are located at the respective different positions along the conveyance direction. More specifically, for example, as illustrated in FIG. 3, the pressure chambers 28 in each pressure-chamber row 29 are spaced apart from each other with a pitch P in the conveyance direction. Between the four pressure-chamber rows 29, a pressure chamber 28 in one (e.g., the pressure-chamber row 29*a*) of the pressure-chamber rows 29 is spaced with a pitch P/4 from a pressure chamber 28 in another (e.g., the pressure-chamber row 29*d*) of the pressure-chamber rows 29 in the conveyance direction.

The manifold substrate 22 is positioned below the channel substrates 21. As illustrated in FIG. 2, the manifold substrate 22 has a size larger than a total size of the channel substrates 21 in plan view. All end portions of the manifold substrate 22 protrude relative to edges of each of the channel substrates 21 in all directions.

As illustrated in FIG. 3, the manifold substrate 22 has a plurality of, for example, four manifolds 30 that are positioned corresponding to the respective pressure-chamber rows 29 and extend along the conveyance direction. The manifolds 30 are positioned side by side in the scanning direction. Each of the manifolds 30 partially overlaps the pressure chambers 28 included in a corresponding one of the pressure-chamber rows 29 when viewed in the top-bottom direction, and communicates with the pressure chambers 28 in the same row in common. As illustrated in FIG. 3, each of the manifolds 30 extends between the opposite end portions of the manifold substrate 22 along the conveyance direction.

As illustrated in FIG. 3, the opposite end portions of the manifold substrate 22 protruding in the conveyance direction (e.g., a direction from rear to front) relative to the edges of each of the channel substrates 21 serve as protruding portions 22*a*. The protruding portions 22*a* have a plurality of openings 31 defined therein. More specifically, for example, two openings 31 are provided for each of the manifolds 30 and communicate with respective ends of a corresponding one of the manifolds 30. That is, the rear protruding portion 22*a* has four openings 31 that are in communication with the respective manifolds 30, and the front protruding portion 22*a* has the other four openings 31 that communicate with the respective manifolds 30. The openings 31 of the manifolds 30 are connected to a corresponding one of the ink cartridges 15 via an ink supply member (not illustrated) having an appropriate configuration. That is, in the illustrative embodiment, all of the manifolds 30 are supplied with the same color ink.

As illustrated in FIG. 5, the manifold substrate 22 has communication holes 32 and 33. The communication holes 32 provide communication between the pressure chambers 28 and the nozzles 36, respectively. The communication holes 33 provide communication between the pressure chambers 28 and a corresponding manifold 30.

With respect to the pressure-chamber rows 29*b* and 29*c* located on the center side in the scanning direction, the communication holes 32 are positioned at respective positions such that the communication holes 32 overlap scanning-direction-outer-end portions of the pressure chambers 28 respectively when viewed in the top-bottom direction. The communication holes 32 communicate with the respective nozzles 36. The communication holes 33 are positioned at respective positions such that the communication holes 33 overlap scanning-direction-inner-end portions of the pressure chambers 28 respectively when viewed in the top-bottom direction. Each communication hole 33 communicate with a corresponding one of the manifolds 30. With respect to the pressure-chamber rows 29*a* and 29*d* located on respective end sides in the scanning direction, the communication holes 32 and 33 are reversed in position relative to the communication holes 32 and 33 for the pressure-chamber rows 29*b* and 29*c*. That is, the communication holes 32 are positioned at respective positions such that the communication holes 32 overlap scanning-direction-inner-end portions of the pressure chambers 28 respectively when viewed in the top-bottom direction. The communication holes 33 are positioned at respective positions such that the communication holes 33 overlap the scanning-direction-outer-end portions of the pressure chambers 28 respectively when viewed in the top-bottom direction.

Flexible damper films 34 are joined to a lower surface of the manifold substrate 22 so as to cover the manifolds 30. The damper films 34 are configured to reduce pressure fluctuation occurring in the manifolds 30. A protective plate 35 is disposed below each of the damper films 34 via a corresponding metal frame spacer 38. The protective plate 35 protects the corresponding damper film 34 while being spaced from the damper film 24.

As illustrated in FIG. 2, the nozzle plates 23 (e.g., 23*a* and 23*b*) are joined to the lower surface of the manifold substrate 22 while being disposed side by side in the scanning direction. The left nozzle plate 23*a* has nozzles 36 corresponding to the left two pressure-chamber rows 29*a* and 29*b*. The nozzles 36 of the nozzle plate 23*a* constitute a plurality of, for example, two nozzle rows 37*a* and 37*b*. The right nozzle plate 23*b* similarly has nozzles 36 corresponding to the right two pressure-chamber rows 29*c* and 29*d*. The nozzles 36 of the nozzle plate 23*b* constitute a plurality of, for example, two nozzle rows 37*c* and 37*d*. Similar to the channel substrates 21, since the left nozzle plate 23*a* including the left nozzle rows 37*a* and 37*b* and the right nozzle plate 23*b* including the right nozzle rows 37*c* and 37*d* are separate plates, a size of the individual nozzle plates 21 may be reduced considerably as a case where a single nozzle plate includes all the four nozzle rows 37.

Similar to the pressure-chamber rows 29, the nozzles 36 are aligned along the conveyance direction in each nozzle row 37. Between the nozzle rows 37*a*, 37*b*, 37*c*, and 37*d*, the nozzles 36 are located at the respective different positions along the conveyance direction. More specifically, for example, as illustrated in FIG. 2, the nozzles 36 in each nozzle row 37 are spaced apart from each other with a pitch P (e.g. equal to the pitch P of the pressure chambers 28) in the conveyance direction. Between the four nozzle rows 37, a nozzle 36 in one (e.g., the nozzle row 37*a*) of the nozzle rows 37 is spaced with a pitch P/4 from a pressure chamber in another (e.g., the nozzle row 37*d*) of the nozzle rows 37 in the conveyance direction. With this configuration, for example, in a case where a single nozzle row 37 achieves printing at resolution of 300 dpi, a single head unit 19 including four nozzle rows 37 may print an image at high resolution of 1200 dpi per color.

(Piezoelectric Actuators)

Hereinafter, the piezoelectric actuators 24 (e.g., 24*a* and 24*b*) will be described. The piezoelectric actuator 24*a* is formed on the channel substrate 21*a* and the piezoelectric actuator 24*b* is formed on the channel substrate 21*b*. In each channel substrate 21, the piezoelectric actuator 24 includes an insulating layer 40 and a plurality of piezoelectric elements 41. The insulating layer 40 is formed on the channel substrate 21 so as to cover the pressure chambers 28. The piezoelectric elements 41 are positioned on the insulating layer 40.

The insulating layer 40 may be a layer of silicon dioxide formed by, for example, oxidation of a surface of the channel substrate 21 made of silicon. The insulating layer 40 has a thickness of, for example, between 1.0 and 1.5 μm.

The piezoelectric elements 41 are disposed on an upper surface of the insulating layer 40 so as to overlap the respective pressure chambers 28 when viewed in the top-bottom direction. In each of the channel substrates 21, the piezoelectric elements 41 constitute a plurality of, for example, two piezoelectric-element rows 47 that are positioned corresponding to the respective pressure-chamber rows 29 and side by side in the scanning direction. That is, the left channel substrate 21*a* includes two piezoelectric-element rows 47*a* and 47*b* corresponding to the pressure-chamber rows 28*a* and 28*b*, respectively. The right channel substrate 21*b* includes the other two piezoelectric-element rows 47*c* and 47*d* corresponding to the pressure chamber rows 28*c* and 28*d*, respectively. Each of the piezoelectric elements 41 is configured to change volume of a corresponding one of the pressure chambers 28 due to its deformation caused by inverse piezoelectric effect. Each of the piezoelectric elements 41 applies ejection energy for ejecting ink stored in a corresponding pressure chamber 28 from a corresponding nozzle 36 by changing the volume of the pressure chamber 28.

The piezoelectric elements 41 will be described in detail. As illustrated in FIGS. 4, 5, and 6, each of the piezoelectric elements 41 includes a lower electrode 42, a piezoelectric layer 43, and an upper electrode 44. The lower electrode 42 is positioned on the insulating layer 40. The piezoelectric layer 43 is positioned on the lower electrode 42. The upper electrode 44 is positioned on the piezoelectric layer 43.

The lower electrode 42 is positioned on an upper surface of the insulating layer 40 so as to overlap the corresponding pressure chamber 28 when viewed in the top-bottom direction. The lower electrode 42 may be an individual electrode to which a drive signal is supplied by a driver IC 60 individually. Similar to the pressure chambers 28, the lower electrodes 42 corresponding to the respective pressure chambers 28 are aligned along the conveyance direction and constitute a plurality of, for example, four electrode rows.

Each of the lower electrodes 42 has an extended portion 45 that extends from a scanning-direction-outer-end portion thereof. The lower electrodes 42 and the extended portions 45 may be made of, for example, platinum (Pt). The lower electrodes 42 and the extended portions 45 each have a thickness of, for example, 0.1 μm.

The piezoelectric layers 43 may be made of, for example, piezoelectric material, e.g., lead zirconate titanate (PZT). Nevertheless, in other embodiments, for example, the piezoelectric layers 43 may be made of lead-free piezoelectric materials. The piezoelectric layers 43 each have a thickness of, for example, between 1.0 and 2.0 μm. As illustrated in FIGS. 3 to 6, in the illustrative embodiment, in the left channel substrate 21*a*, the piezoelectric layers 43 of the piezoelectric elements 41 corresponding to one or the other of the pressure-chamber rows 29*a* and 29*b* are contiguous to each other. Similar to this, in the right channel substrate 21*b*, the piezoelectric layers 43 of the piezoelectric elements 41 corresponding to one or the other of the pressure-chamber rows 29*c* and 29*d* are contiguous to each other. That is, in each of the channel substrates 21*a* and 21*b*, the piezoelectric layers 43 constitute a piezoelectric member 46.

As illustrated in FIGS. 3 to 6, each piezoelectric member 46 has slits 48 each extending along the scanning direction. Each slit 48 is positioned between each adjacent two of the pressure chambers 28 with respect to the conveyance direction. The piezoelectric layer 43 has a plurality of separated portions that are separated by the slits 48 at the respective positions between adjacent two of the pressure chambers 28 in the conveyance direction. In other words, a single slit 48 is provided on each side of each pressure chamber 28 in the conveyance direction.

As illustrated in FIGS. 3, 4, and 6, each extended portion 45 connected to a corresponding lower electrode 42 extends from the lower electrode 42 outwardly along the scanning direction. More specifically, for example, the extended portions 45 of the lower electrodes 42 corresponding to one or the other of the pressure-chamber rows 29*a* and 29*d* located on the end sides extend outwardly beyond an edge of a corresponding piezoelectric member 46, and are uncovered by the piezoelectric member 46. More specifically, for example, the extended portions 45 of the lower electrodes 42 corresponding to one or the other of the pressure-chamber rows 29*b* and 29*c* located on the center side extend to the respective slits 48 corresponding to the pressure-chamber rows 29*a* and 29*d* located on the end sides, and are exposed through the slits 48 (i.e., uncovered by the piezoelectric member 46). Leads 52 are connected to the end portions of the respective extended portions 45 that are uncovered by the corresponding piezoelectric member 46.

The upper electrodes 44 are positioned on the upper surface of the insulating layer 43 so as to overlap the respective pressure chambers 28 when viewed in the top-bottom direction. The upper electrodes 44 may be made of, for example, iridium. The upper electrode 44 has a thickness of, for example, 0.1 μm. In each piezoelectric member 46, the upper electrodes 44 are contiguous to each other at an upper surface of the piezoelectric member 46 and thus constitute a common electrode 49 that covers substantially an entire portion of the upper surface of the piezoelectric member 46. The common electrode 49 consisting of the upper electrodes 44 is applied with ground potential.

As illustrated in FIGS. 3 and 4, each common electrode 49 has a cut 49*a* in each region between each adjacent two of the pressure chambers 28. An outer end portion of each common electrode 49 in the scanning direction includes the regions having the cuts 49*a*. The cuts 49*a* are cut out from the outer end side. In other words, in each of the pressure-chamber rows 29*a* and 29*d* located on the end sides, the common electrode 49 does not lay over the slits 48 each positioned between each adjacent two of the pressure chambers 28 in the conveyance direction.

An auxiliary conductor 50 is disposed on each of the common electrodes 49. The auxiliary conductors 50 are in contact with the respective common electrodes 49. Providing the auxiliary conductor 50 on each of the common electrodes 49 establishes another current-passing route in addition to the route through each of the common electrodes 49, thereby reducing potential difference that may occur in each of the common electrodes 49. The auxiliary conductors 50 may be made of, for example, gold (Au). The auxiliary conductors 50 have a thickness greater than a thickness of the common electrodes 49.

Each of the auxiliary conductors 50 includes a first conductive portion 50*a* and a plurality of, for example, two second conductive portions 50*b*. The second conductive portions 50*b* are electrically continuous to the first conductive portion 50*a*. The first conductive portion 50*a* is disposed at an inner end portion of the piezoelectric member 46 in the scanning direction. The first conductive portion 50*a* extends along the conveyance direction. The second conductive portions 50*b* are disposed at opposite end portions of the piezoelectric member 46 in the conveyance direction. Each of the second conductive portions 50*b* is connected to the first conductive portion 50*a*. The second conduction portions 50*b* extend outwardly from respective ends of the first conductive portion 50*a* to an end area EA in the scanning direction. The end area EA is located at a more outer position than the piezoelectric-element rows 47.

As described above, the extended portions 45 extend outwardly along the scanning direction from the respective lower electrodes 42, and further extend beyond the piezoelectric member 46. The leads 52 are connected to the exposed end portions of the respective extended portions 45. The leads 52 extend outwardly along the scanning direction from the end portions of the respective extended portions 45 to the end area EA. The leads 52 connected to the one or the other of the piezoelectric-element rows 47*b* and 47*c*, respectively, positioned on the center side in the scanning direction, extend through the respective slits 48 corresponding to the one or the other of the pressure-chamber rows 29*a* and 29*d*, respectively. The common electrode 49 has the cuts 49*a* corresponding to the respective slits 48, and therefore, the common electrode 49 does not lay over the slits 48. With this configuration, the leads 52 extending through the respective slits 48 do not contact the common electrode 49. The leads 52 may be made of, for example, gold (Au). The leads 52 are formed by the same layer formation process used for forming the auxiliary conductors 50. The leads 52 have a thickness greater than a thickness of the lower electrodes 42.

In the end area EA of the insulating layer 40 of each of the channel substrates 21, a plurality of drive contacts 53 and a plurality of, for example, two ground contacts 54 are positioned. The drive contacts 53 are aligned in a row along the conveyance direction. The ground contacts 54 are positioned upstream and downstream, respectively, of the row of the drive contacts 53 in the conveyance direction. The drive contacts 53 are positioned between the ground contacts 54 in the conveyance direction. The leads 52 are connected to the respective drive contacts 53. The second conductive portions 50*b* of the auxiliary conductor 50 are connected to the respective ground contacts 54.

(Cover Members)

As illustrated in FIGS. 2 and 5, the cover members 25 are disposed on the respective channel substrates 21 so as to cover the piezoelectric elements 41. The drive contacts 53 and the ground contacts 54 positioned in the end areas EA of the insulating layers 40 are uncovered by the cover members 25. Although material for the cover members 25 is not limited particularly, for example, silicone may be used preferably for the cover members 25.

(COFs)

The COFs 26 each may be a wiring board made of a flexible resin film including wirings (not illustrated). As described above, in the end area EA of the insulating layer 40 of each of the channel substrates 21, the drive contacts 53 and the ground contacts 54 are aligned in a row. In each of the channel substrates 21, one of opposite end portions of a single COF 26 is joined to the end area EA of the insulating layer 40 using a conductive adhesive. Thus, the drive contacts 53 and the ground contacts 54 are electrically connected to the COF 26. As illustrated in FIG. 5, a circuit board 58 is disposed above the four head units 19. The other of the opposite end portions of the COF 26 extends to an upper surface of the circuit board 58 through one of through holes of the circuit board 58 and is connected to a terminal on the circuit board 58. The circuit board 58 is connected to the controller 7 (refer to FIG. 1).

Each COF 26 includes a driver IC 60 mounted on a portion thereof in the top-bottom direction. The driver IC 60 is electrically connected to the controller 7 via the wiring (not illustrated) of a corresponding COF 26. The driver IC 60 is also electrically connected to the drive contacts 53 via the wiring of the COF 26. The driver IC 60 is configured to, in response to a control signal transmitted from the controller 7, output a drive signal to appropriate one or more of the lower electrodes 42 connected to the drive contacts 53 to switch the potential of the appropriate one or more of the lower electrodes 42 between a ground potential and a predetermined potential. The ground contacts 54 are electrically connected to a ground wire (not illustrated) of a corresponding COF 26, and the upper electrodes 49 constituting the common electrode 49 are kept at the ground potential.

Behavior of each piezoelectric element 41 when a drive signal is supplied to the appropriate one or more of the lower electrodes 42 from the driver IC 60 will be described. Since all of the piezoelectric elements 41 behave in the same manner, an explanation will be made on one of the piezoelectric elements 42. While a drive signal is not supplied to a lower electrode 42, the lower electrode 42 is at the ground potential that is equal to the potential of a corresponding upper electrode 44. In this state, when a drive potential is applied to the lower electrode 42 in response to supply of a drive signal to the lower electrode 42, a potential difference is caused between the lower electrode 42 and the corresponding upper electrode 44 and an electric field that is directed in a direction parallel to a thickness direction of the piezoelectric layer 43 occurs. Due to the occurrence of the electric field, the piezoelectric layer 43 expands in its thickness direction and contracts in its surface-extending direction. Thus, a portion of the insulating layer 40 covering a corresponding pressure chamber 28 deforms so as to protrude toward the pressure chamber 28. Therefore, the volume of the pressure chamber 28 is reduced and a pressure wave occurs in the pressure chamber 28, thereby causing ink ejection from a nozzle 36 communicating with the pressure chamber 28.

Figure 7A:
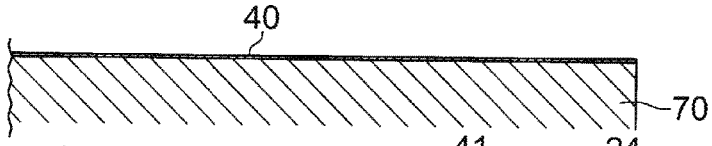
FIGS. 7A to 7G illustrate a process of manufacturing the head unit in the illustrative embodiment according to one or more aspects of the disclosure.
Figure 7B:
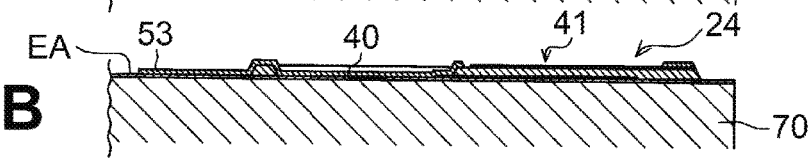
Figure 7C:
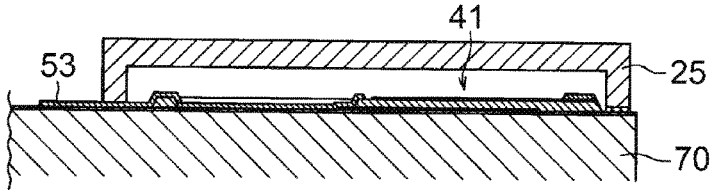

Hereinafter, a process of manufacturing one of the head units 19 will be described in detail. All of the head units 19 are manufactured by the same process. FIGS. 7A to 7G illustrate an example process of manufacturing one of the head units 19. FIGS. 7A to 7C illustrate a portion of a silicon substrate 70, and FIGS. 7D to 7G illustrates one (e.g., the left channel substrate 21*a*) of the channel substrates 21 and its corresponding portions only. In the illustrative embodiment, piezoelectric elements 41 are formed on a silicon substrate 70 that is a base material for channel substrates 21 of head units 19. Then, the silicon substrate 70 is cut into a plurality of channel substrates 21.

More specifically, for example, as illustrated in FIG. 7A, as a first step, a silicon-dioxide insulating layer 40 is formed on one (e.g., an upper surface) of opposite surfaces of a silicon substrate 70 by heat oxidation. Then, lower electrodes 42, upper electrodes 43, auxiliary conductors 50, leads 52, drive contacts 53, and ground contacts 54 are formed on the insulating layer 40 successively by respective appropriate layer formation methods. Thus, as illustrated in FIG. 7B, a piezoelectric actuator 24 having piezoelectric elements 41 is formed on the insulating layer 40.

Figure 7D:
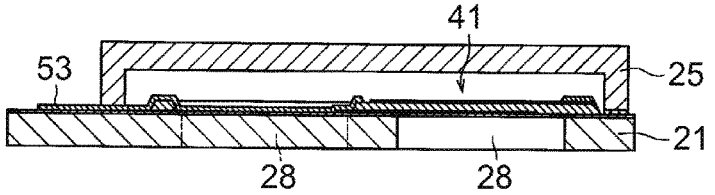

Subsequent to this, as illustrated in FIG. 7C, a cover member 25 is joined to the insulating layer 40 so as to cover appropriate ones of the piezoelectric elements 41, i.e., two rows of piezoelectric elements 41. Another cover member 25 is joined to the insulating layer 40 in the same manner. Thereafter, as illustrated in FIG. 7D, the thickness of the silicon substrate 70 is made to be a predetermined thickness by rubbing of the other surface of the silicon substrate 70. The other surface is opposite to the one surface on which the piezoelectric elements 41 have been formed. Then, pressure chambers 28 are formed on the silicon substrate 70 by etching. Subsequent to this, the silicon substrate 70 is cut into a plurality of pieces to provide a plurality of channel substrates 21. Through these steps, manufacturing of a single channel substrate 21 including the piezoelectric elements 41 is completed.

Figure 7E:
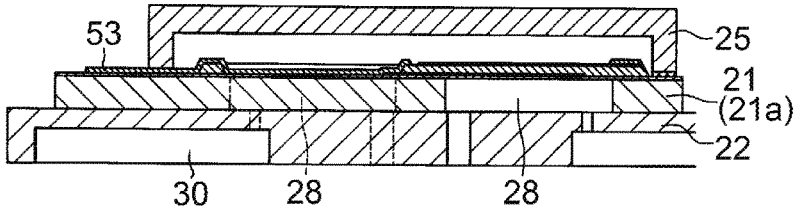
Figure 7F:
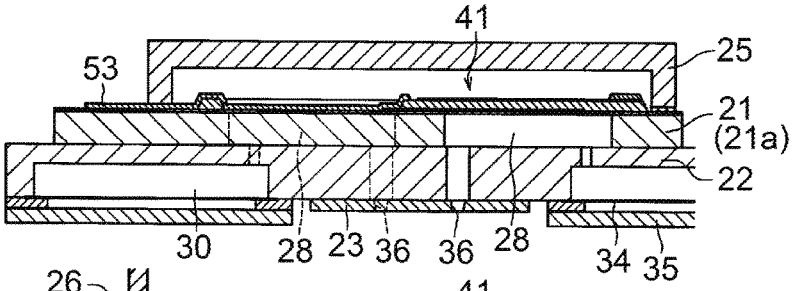

Then, as illustrated in FIG. 7E, a manifold substrate 22 is joined to lower surfaces of two channel substrates 21 (the right channel substrate 21 is omitted in FIG. 7E), and channels including, e.g., manifolds 30, are formed in the manifold substrate 22 by etching. After that, as illustrated in FIG. 7F, nozzle plates 23, damper films 34, and protective plates 35 are joined to a lower surface of the manifold substrate 22.

Figure 7G:
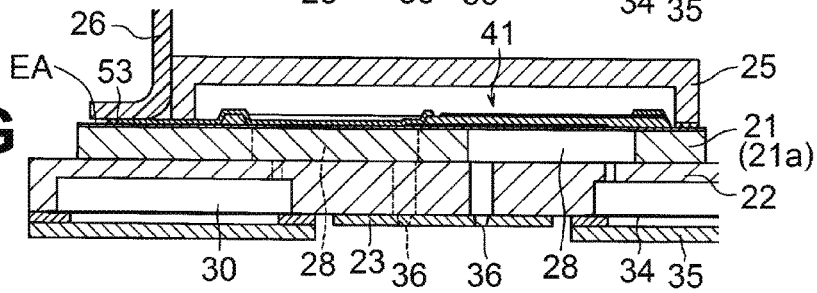

Subsequent to this, as illustrated in FIG. 7G, in each channel substrate 21, a COF 26 is joined to an end area EA of the insulating layer 40 where the drive contacts 53 and the ground contacts 54 are positioned. More specifically, for example, while a conductive adhesive is applied between the COF 26 and the end area EA of the insulating layer 40, the COF 26 is joined to the channel substrate 21 by heat pressing. Thus, in each channel substrate 21, the drive contacts 53 aligned in a row in the end area EA are electrically connected to the corresponding COF 26.

In the head unit 19, the pressure chambers 28 are aligned along the conveyance direction and constitute four pressure-chamber rows 29 positioned side by side in the right-left direction. More specifically, for example, the channel substrate 21*a* including two pressure-chamber rows 29*a* and 29*b* and the channel substrate 21*b* including the other two pressure-chamber rows 29*c* and 29*d* are disposed side by side in the right-left direction. In accordance with the arrangement pattern of the pressure chambers 28, the piezoelectric elements 41 corresponding to the respective pressure chambers 28 also constitute four piezoelectric-element rows 47. That is, the left channel substrate 21*a* includes two piezoelectric-element rows 47*a* and 47*b* and the right channel substrate 21*b* includes the other two piezoelectric-element rows 47*c* and 47*d*. In the channel substrate 21*a*, the drive contacts 53 are positioned in the end area EA that is defined at the more outer position than the piezoelectric-element rows 47*a* and 47*b* in the scanning direction. Similarly, in the channel substrate 21*b*, the drive contacts 53 are positioned in the end area EA that is defined at the more outer position than the piezoelectric-element rows 47*c* and 47*d* in the scanning direction.

That is, the drive contacts 53 extending from the left two piezoelectric-element rows 47*a* and 47*b* are positioned at one outer position in the scanning direction and the drive contacts 53 extending from the right two piezoelectric-element rows 47*c* and 47*d* are positioned at the other outer position in the scanning direction, i.e., the drive contacts 53 are positioned at the respective outer positions across the four the piezoelectric-element rows 47 in the scanning direction. In other words, no drive contact 53 is positioned between each adjacent two of the piezoelectric-element rows 47 in the scanning direction. Thus, a distance between each adjacent two of the piezoelectric-element rows 47 in the scanning direction may be reduced. Consequently, a distance between each adjacent two of the nozzles rows 37 in the scanning direction may be also reduced, and therefore, the four nozzle rows 37 may be positioned near the central portion in the scanning direction.

As described referring to FIGS. 7A to 7G, the process of manufacturing the channel substrate 21 includes the step of forming the piezoelectric elements 41 on the insulating layer 40 by the layer formation method. Nevertheless, generally, using the layer formation method may increase in the manufacturing costs. Nevertheless, in the illustrative embodiment, as described above, the drive contacts 53 are positioned at the respective outer positions across the four pressure-chamber rows 29 in the scanning direction. Therefore, this configuration may enable to provide two separate channel substrates 21, one of which including the left pressure-chamber rows 29*a* and 29*b* and the other of which including the right pressure-chamber rows 29*c* and 29*d*.

Thus, the dimension of each of the channel substrates 21 is smaller than a half of the dimension of the single channel substrate including all the four pressure-chamber rows 29 in the scanning direction. Therefore, in the step of FIG. 7D, the number of channel substrates 21 that can be obtained from a single silicon substrate 70 may be increased, thereby reducing the costs for manufacturing individual channel substrates 21. In addition, the size reduction of individual channel substrates 21 may increase yields as compared with a case where relatively-large-sized channel substrates 21 are obtained from a single silicon substrate 70.

As illustrated in FIG. 5, inner-end portions of the channel substrates 21*a* and 21*b* partially overlap the respective corresponding manifolds 30 positioned at the central portion of the manifold substrate 22 in the scanning direction when viewed in the top-bottom direction. In the manifold substrate 22, the portions having the manifolds 30 have lower rigidity than the other portions. Therefore, the end portions of the channel substrates 21 may be supported unstably. Nevertheless, in the illustrative embodiment, the manifold substrate 22 includes a partition wall 22*b*. The partition wall 22*b* is positioned between the inner-end portion of the channel substrate 21*a* and the inner-end portion of the channel substrate 21*b* and separates the manifolds 30 positioned at the central portion. With this configuration, the inner-end portions of the channel substrates 21*a* and 21*b* may surely supported by the manifold substrate 22.

Each opening for supplying ink to a corresponding one of the manifolds 30 may be defined in an any arbitrary position. Nevertheless, if such an opening is positioned between each adjacent two of the pressure-chamber rows 29, the distance between adjacent two of the piezoelectric-element rows 47 in the scanning direction may be increased. Therefore, in the illustrative embodiment, the end portions of the manifold substrate 22 in the conveyance direction protrude relative to the edges of the channel substrates 21 to provide the protruding portions 22*a*, and the openings 31 for the manifolds 30 are defined in the protruding portions 22*a*. That is, the openings 31 for the manifolds 30 are positioned at the end portions of the manifold substrate 22 in the conveyance direction. This configuration may therefore reduce the distance between adjacent two of the piezoelectric-element rows 47 in the scanning direction. Further, there may be no need to provide the openings 31 for the manifolds 30 in the channel substrates 21. Therefore, this configuration may also restrict size increase of the channel substrates 21.

If each of the manifolds 30 is supplied with ink from only one of the opposite ends thereof, insufficient distribution of ink may occur in one or more pressure chambers 28 positioned closer to the other end of each of the manifolds 30. Therefore, in the illustrative embodiment, both of the end portions of the manifold substrate 22 in the conveyance direction protrude relative to the edges of the channel substrates 21 to provide the protruding portions 22*a*, and the openings 31 for the manifolds 30 are defined in the protruding portions 22*a*. Consequently, this configuration may achieve ink supply to each of the manifolds 30 from the both ends thereof in the conveyance direction, and may also restrict size increase of the individual channel substrates 21.

Hereinafter, alternative embodiments in which various changes or modifications are applied to the illustrative embodiment will be described. An explanation will be given mainly for the elements different from the illustrative embodiment, and an explanation will be omitted for the common elements by assigning the same reference numerals thereto.

1] The channel configuration in the manifold substrate 22 is not limited to the specific example of the illustrative embodiment, and various changes or modifications may be applied thereto. In the illustrative embodiment, with respect to the pressure-chamber rows 29*a* and 29*d* located on the respective end sides in the scanning direction, the communication holes 32 and 33 are reversed in position relative to the communication holes 32 and 33 for the pressure-chamber rows 29*b* and 29*c*. Nevertheless, in other embodiments, for example, the communication holes 32 and 33 for the pressure-chamber rows 29*a* and 29*d* may be positioned on the same respective positions as the communication holes 32 and 33 for the pressure-chamber rows 29*b* and 29*c*. As illustrated in FIG. 5, in the illustrative embodiment, while the communication holes 32 that provide communication between the nozzles 36 and the pressure chambers 28, respectively, overlap the outer-end portions of the respective pressure chambers 28 in the pressure-chamber rows 29*b* and 29*c* located on the center side, the communication holes 32 overlap the inner-end portions of the respective pressure chambers 28 in the pressure-chamber rows 29*a* and 29*d*. In other embodiments, for example, with respect to all of the pressure-chamber rows 29, the communication holes 32 may communicate with the inner-end portions of the respective pressure chambers 28.

2] According to the illustrative embodiment, in each of the head units 19, ink of the same color is supplied to all the four pressure-chamber rows 29 and is ejected from all the four nozzle rows 37. Nevertheless, in other embodiments, for example, in each of the head units 19, all of the nozzle rows 37 might not necessarily eject ink of the same color therefrom. In one example, the left two nozzle rows 37*a* and 37*b* may eject ink of one color and the right two nozzle rows 37*c* and 37*d* may eject ink of another color. In another example, the nozzle rows 37 may eject ink of different colors, respectively.

3] In the illustrative embodiment, the nozzle plates 23 are separate from each other and disposed on the right and left, respectively. Nevertheless, in other embodiments, for example, a relatively large single nozzle plate including all the four nozzle rows 37 may be used.

4] In the illustrative embodiment, the manifolds 30 are provided in a one-to-one correspondence to the pressure-chamber rows 29 so as to overlap the respective pressure-chamber rows 29. Nevertheless, in other embodiments, for example, at least one of the manifolds 30 may be provided in a one-to-two correspondence to the pressure-chamber rows 29 so as to extend between two of the pressure-chamber rows 29.

Figure 8:
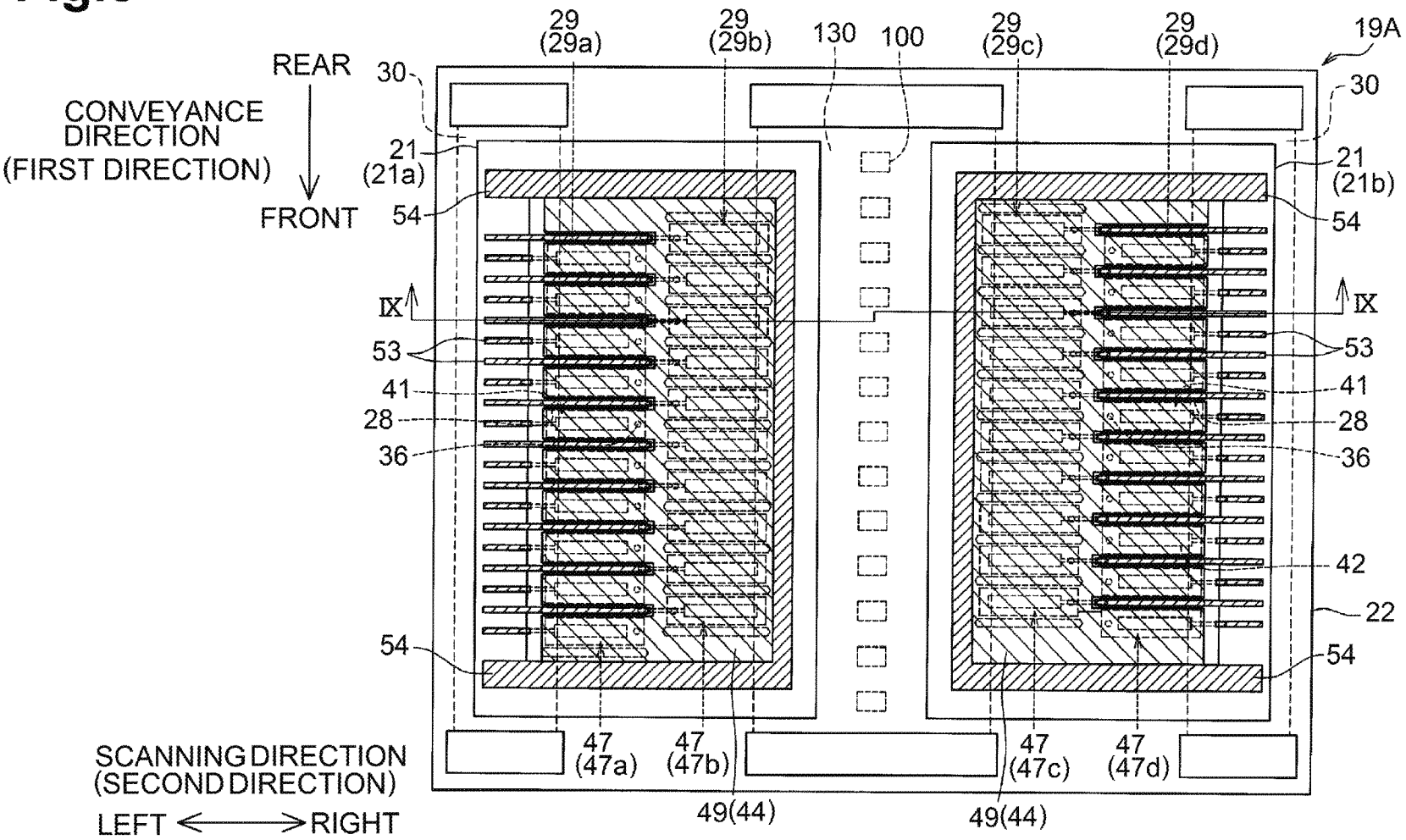
FIG. 8 is a plan view of a head unit in an alternative embodiment according to one or more aspects of the disclosure.
Figure 9:
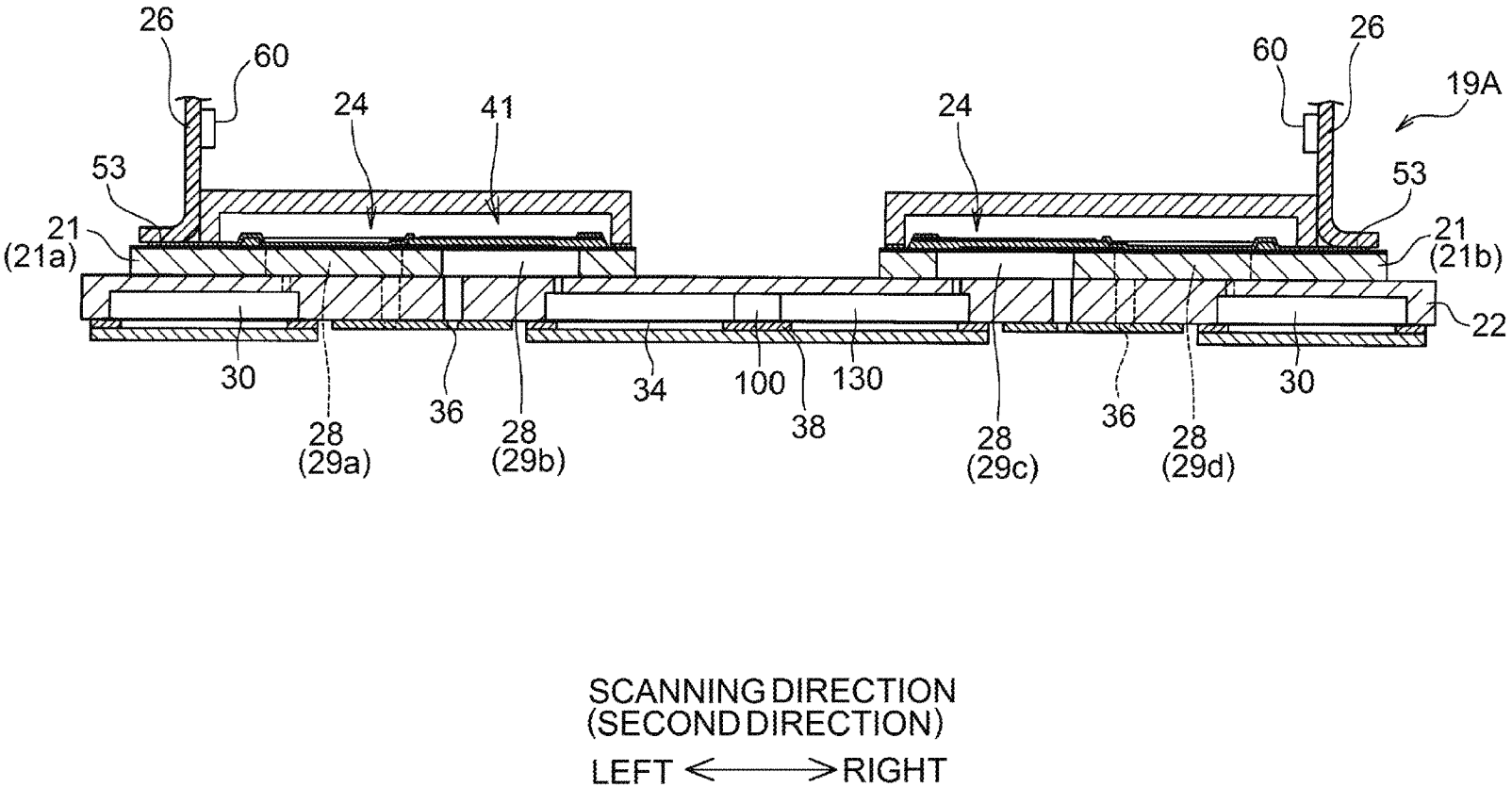
FIG. 9 is a sectional view taken along line IX-IX of FIG. 8 in the alternative embodiment according to one or more aspects of the disclosure.

In one example, as illustrated in FIGS. 8 and 9, the manifold substrate 22 may have a relatively wide manifold 130 in its central portion in the scanning direction so as to extend between the pressure-chamber rows 29*b* and 29*c*. In each of the pressure-chamber rows 29*b* and 29*c*, the inner-end portions of the pressure chambers 28 may communicate with the manifold 130. That is, the manifold 130 may be configured to supply ink to both of the pressure-chamber rows 29*b* and 29*c* in common. In this configuration, the manifold substrate 22 has no partition wall (e.g., the partition wall 22*b* of FIG. 5) between the pressure-chamber rows 29*b* and 29*c*. Therefore, while the distance between the pressure-chamber rows 29*b* and 29*c* is reduced, the volume of the manifold 130 may be increased.

Nevertheless, this configuration may decrease rigidity of the central portion of the manifold substrate 22 having the relatively wide manifold 130. Thus, the inner-end portions of the channel substrates 21 may be supported by the manifold substrate 22 unstably. Therefore, for example, as illustrated in FIGS. 8 and 9, a plurality of supports 100 may be disposed between the channel substrates 21 in the scanning direction in the manifold 130. The supports 100 may be aligned in a row along the conveyance direction. Each support 100 may extend from a top surface of the manifold 130 to the metal spacer 38 and contact the spacer 38 via the damper film 34 that may define a lower end of the manifold 130. As illustrated in FIG. 8, the supports 100 may be spaced apart from each other in the conveyance direction. Right and left portions of the manifold 100 relative to the supports 100 communicate with each other via spacings between adjacent supports 100. Providing the supports 100 may enhance the rigidity of the portion of the manifold substrate 22 where the manifold 130 is defined. Therefore, the inner-end portions of the channel substrates 21*a* and 21*b* may be surely supported by the manifold substrate 22.

Figure 10:
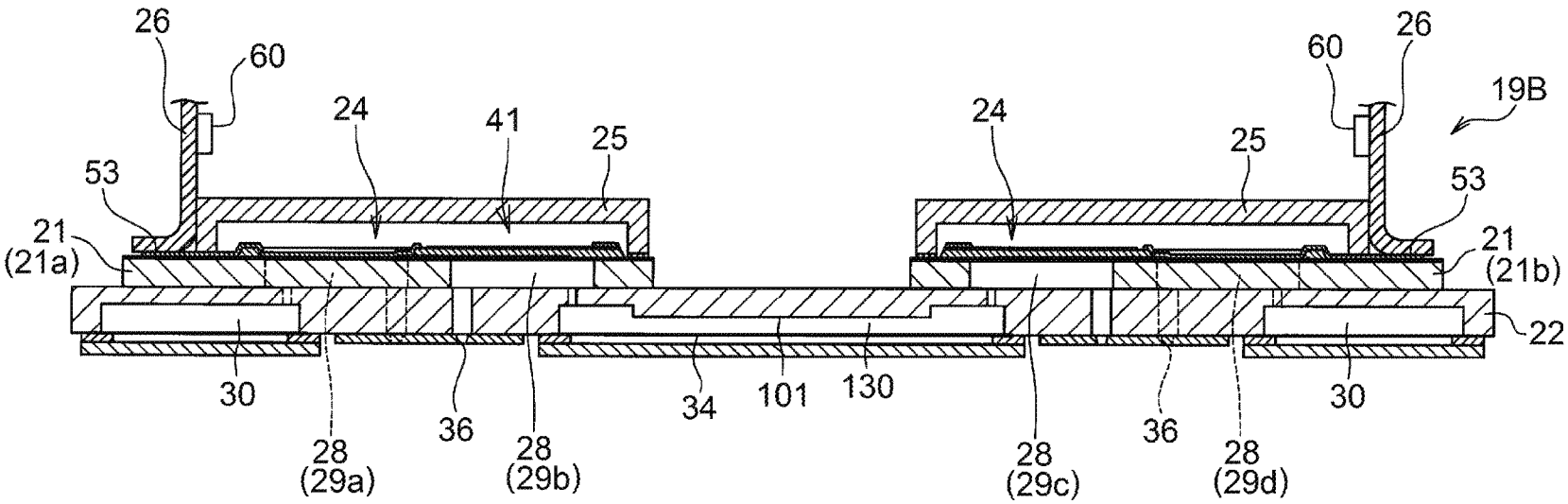
FIG. 10 is a plan view of a head unit in another alternative embodiment according to one or more aspects of the disclosure.

In other embodiments, for example, instead of providing the supports 100 in the manifold 130, as illustrated in FIG. 10, a manifold substrate 22 of a head unit 19B may include a projecting portion 101 at its upper wall defining a portion of the manifold 130. The projecting portion 101 may be positioned in the manifold 130 and between the channel substrates 21*a* and 21*b* in the scanning direction. In this configuration, the projecting portion 101 may enhance the rigidity of the portion of the manifold substrate 22 where the manifold 130 is defined. Therefore, the inner-end portions of the channel substrates 21*a* and 21*b* may be surely supported by the manifold substrate 22. The projecting portion 101 may have a width in the scanning direction such that end portions of the projecting portion 101 in the scanning direction overlap the channel substrates 21*a* and 21*b*, respectively, when viewed in the top-bottom direction.

As opposed to the configuration illustrated in FIG. 9, the projecting portion 101 does not contact the spacer 38. Therefore, in this configuration, the spacer 38 might not necessarily be needed below the projecting portion 101 in light of increasing the damper effect. As illustrated in FIG. 10, clearance may be provided between a lower end of the projecting portion 101 and the damper film 34 that may define the bottom of the manifold 130. Therefore, right and left portion of the manifold 130 relative to the projecting portion 101 may communicate with each other via the clearance. In this alternative embodiment, in one example, the manifold substrate 22 may include a plurality of projecting portions 101 spaced apart from each other in the conveyance direction. In another example, the manifold substrate 22 may include a single projecting portion 101 extending continuously along the conveyance direction.

Figure 11:
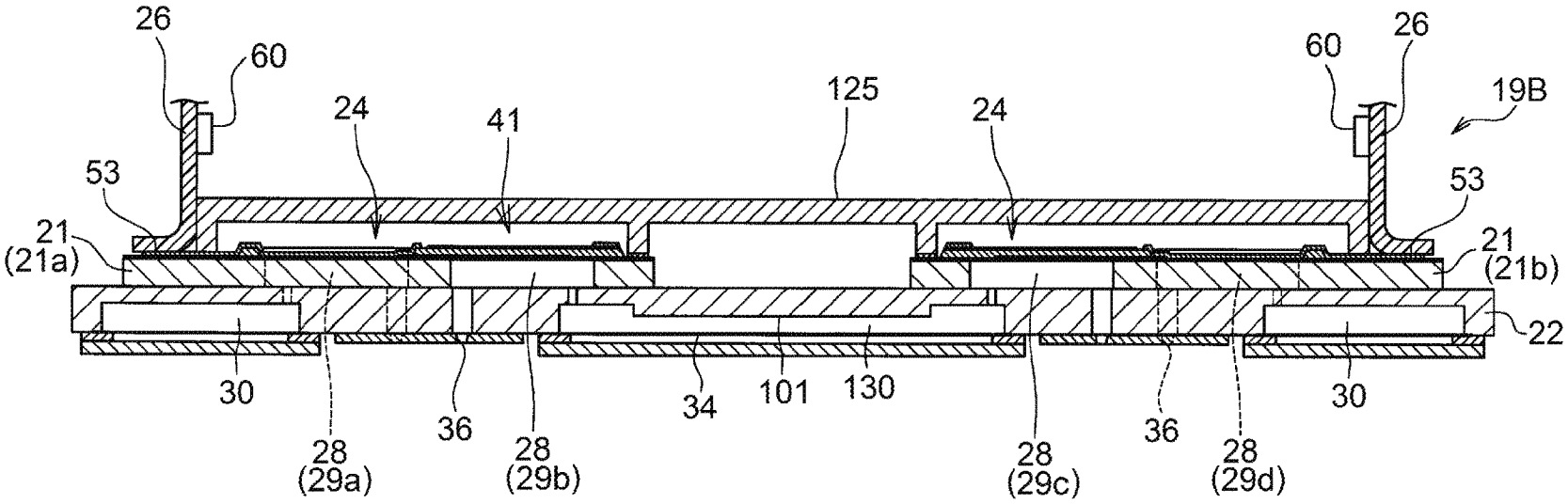
FIG. 11 is a plan view of a head unit in a still another alternative embodiment according to one or more aspects of the disclosure.

In other embodiments, for example, as illustrated in FIG. 11, a single cover member 125 may be joined to the channel substrates 21*a* and 21*b* in common. The common cover member 125 may provide a strong support structure.

5] Various changes may be applied to the positions of the drive contacts 53 in the end area EA or the number of COFs joined to the drive contacts 52 or the positions of the COFs.

In the illustrative embodiment, the drive contacts 53 are aligned in a row along the conveyance direction in each end area EA. Nevertheless, in other embodiments, for example, the drive contacts 53 may be aligned in two or more rows along the conveyance direction in each end area EA. In the illustrative embodiment, a single COF 26 is joined to a single end area EA. Nevertheless, in other embodiments, for example, two or more COFs 26 may be joined to the single end area EA. In one example, the drive contacts 53 may be aligned in a row along the conveyance direction. A COF 26 may be joined to a front half of the row of the drive contacts 53 in the conveyance direction, and another COF 26 may be joined to a rear half of the row of the drive contacts 53 in the conveyance direction.

6] In the illustrative embodiment, the pressure chambers 28 of each channel substrate 21 constitute four pressure-chamber rows 29. Nevertheless, in other embodiments, for example, the pressure chambers 28 of each channel substrate 21 may constitute five or more pressure-chamber rows 29.

The description has been made on the example in which the disclosure is applied to the inkjet head for printing an image on a recording sheet by ejecting ink therefrom. Nevertheless, in other variations or embodiments, for example, the disclosure may be applied to other liquid ejection devices used for various purposes. For example, the disclosure may be applied to a liquid ejection device configured to form conductive patterns on a surface of a substrate by ejecting conductive liquid onto the substrate.

What is claimed is:

1. A liquid ejection device comprising:

a first channel member having a plurality of first pressure chambers constituting a first pressure-chamber row and a second pressure-chamber row, wherein the first and second pressure-chamber rows extend along a first direction and the second pressure-chamber row is next to the first pressure-chamber row in a second direction orthogonal to the first direction;

a second channel member positioned next to the first channel member in the second direction, the second channel member having a plurality of second pressure chambers constituting a third pressure-chamber row and a fourth pressure-chamber row, wherein the third and fourth pressure-chamber rows extend along the first direction and the fourth pressure-chamber row is next to the third pressure-chamber row in the second direction; and a liquid chamber member having a common liquid chamber communicating in common with pressure chambers included in the second pressure-chamber row, wherein the second pressure-chamber row is positioned between the first pressure-chamber row and the third pressure-chamber row in the second direction, wherein the third pressure-chamber row is positioned between the second pressure-chamber row and the fourth pressure-chamber row in the second direction, and wherein the common liquid chamber extending from the second pressure-chamber row to the third pressure-chamber row in the second direction.

2. The liquid ejection device according to claim 1, wherein the second pressure-chamber row and the third pressure-chamber row communicate with the common liquid chamber.

3. The liquid ejection device according to claim 1, wherein a support is disposed in the common liquid chamber and between the first channel member and the second channel member in the second direction.

4. The liquid ejection device according to claim 1, wherein the liquid chamber member includes a projecting portion at a wall thereof, wherein the wall defines a portion of the common liquid chamber, and wherein the projecting portion is positioned between the first channel member and the second channel member in the second direction and the projecting portion extends towards an opposite wall opposing to the wall.

5. The liquid ejection device according to claim 1, wherein pressure chambers of the second pressure-chamber row are offset with pressure chambers of the first pressure-chamber row in the first direction.

6. The liquid ejection device according to claim 1, wherein pressure chambers of the third pressure-chamber row are offset with the pressure chambers of the first pressure-chamber row in the first direction, and the pressure chambers of the third pressure-chamber row are offset with the pressure chambers of the second pressure-chamber row in the first direction.

7. A liquid ejection device comprising:

a first channel member having a plurality of first pressure chambers constituting a first pressure-chamber row extending along a first direction, wherein the first channel member extends from one end of the first channel member in a second direction orthogonal to the first direction to another end of the first channel member in the second direction;

a second channel member having a plurality of second pressure chambers constituting a second pressure-chamber row extending along the first direction, wherein the second channel member extends from one end of the second channel member in the second direction to another end of the second channel member in the second direction;

a liquid chamber member having a common liquid chamber communicating in common with pressure chambers included in the first pressure-chamber row, wherein the second channel member is positioned next to the first channel member in the second direction, wherein the another end of the first channel member in the second direction and the one end of the second channel member in the second direction are positioned between the one end of the first channel member in the second direction and the another end of the second channel member in the second direction, wherein the common liquid chamber extends from one end of the common liquid chamber in the second direction to another end of the common liquid chamber in the second direction, and wherein the another end of the first channel member in the second direction and the one end of the second channel member in the second direction are positioned between the one end of the common liquid chamber in the second direction and the another end of the common liquid chamber in the second direction.

8. The liquid ejection device according to claim 7, wherein the first pressure-chamber row and the second pressure-chamber row communicate with the common liquid chamber.

9. The liquid ejection device according to claim 7, wherein a support is disposed in the common liquid chamber and between the one end of the common liquid chamber in the second direction and the another end of the common liquid chamber in the second direction.

10. The liquid ejection device according to claim 9, wherein the support is disposed between the another end of the first channel member in the second direction and the one end of the second channel member in the second direction.

11. The liquid ejection device according to claim 7, wherein the liquid chamber member includes a projecting portion at a wall thereof, wherein the wall defines a portion of the common liquid chamber, wherein the projecting portion is positioned between the one end of the common liquid chamber in the second direction and the another end of the common liquid chamber in the second direction, and wherein the projecting portion extends toward an opposite wall opposing to the wall.

12. The liquid ejection device according to claim 11, wherein the projecting portion extends from one end of the projecting portion in the second direction to another end of the projecting portion in the second direction, wherein the one end of the projecting portion in the second direction is disposed between the one end of the first channel member in the second direction and the another end of the first channel member in the second direction.

13. The liquid ejection device according to claim 12, wherein the another end of the projecting portion in the second direction is disposed between the one end of the second channel member in the second direction and the another end of the second channel member in the second direction.

* * * * *